United States Patent [19]

Kueny

[11] Patent Number: 4,496,877

[45] Date of Patent: Jan. 29, 1985

[54] UNIPOTENTIAL ELECTRON GUN FOR SHORT CATHODE RAY TUBES

[75] Inventor: Cindee C. Kueny, Mt. Prospect, Ill.

[73] Assignee: Zenith Electronics Corporation, Glenview, Ill.

[21] Appl. No.: 366,024

[22] Filed: Apr. 6, 1982

[51] Int. Cl.[3] ..... H01J 29/46; H01J 29/56

[52] U.S. Cl. ..... 315/15; 313/449

[58] Field of Search ..... 315/14, 15, 16, 382, 315/31 TV; 313/449

[56] References Cited

U.S. PATENT DOCUMENTS 3,919,583 11/1975 Hasker et al. .
4,124,810 11/1978 Bortfeld et al. .
4,232,246 11/1980 Sakurai et al. .
4,277,722 7/1981 Hawken et al. .
4,287,450 9/1981 Kawakami et al. .

*Primary Examiner*—Theodore M. Blum
*Attorney, Agent, or Firm*—Cornelius J. O'Connor

[57] ABSTRACT

A high-performance, unipotential-type electron gun is disclosed. The gun according to the invention comprises a series of apertured electrodes having electrical potentials thereon for establishing electrostatic fields therebetween. The electrodes, which are aligned in spaced relation on an axis, are in the order named, lower end means including a cathode for generating a source of electrons from which an electron beam is formed, apertured plate control and grid electrodes for forming, in conjunction with a cathode and the control electrode, a first cross-over constriction in the beam. The beam exhibits upon divergence from the cross-over constriction a relatively steep cross-over emergence angle. The gun includes a three-element focus lens means for producing a finely focused electron beam. The dimensions, spacings and potentials of the electrodes of the lower end are effective to induce a second constriction of the beam upon entry of the beam into the focus lens for providing, upon subsequent divergence of the beam, a relatively shallow focus lens entry angle effective to provide for optimum filling of the lens by the beam for producing a finely focused beam of electrons.

4 Claims, 4 Drawing Figures

UNIPOTENTIAL ELECTRON GUN FOR SHORT CATHODE RAY TUBES

BACKGROUND OF THE INVENTION AND PRIOR ART DISCLOSURE STATEMENT

This invention relates generally to cathode ray picture tubes. It is specifically addressed to an electron gun for use in small, short picture tubes intended primarily for dashboard installation in vehicles.

An electron gun for use in a cathode ray tube intended for a vehicle (a "VCRT"), must meet severe operational and physical constraints. These constraints are best explained by comparison of the VCRT with the standard cathode ray tube of five-inch diagonal measure intended for use in small television receivers.

Peak brightness of the VCRT, for example, is preferably of the order of ten times the brightness (under typical operating conditions) of a cathode ray tube used in a consumer product television receiver. This magnitude of brightness is required to provide adequate image legibility in the high ambient light environment encountered during day-time operation. This includes the possibility of direct sunlight falling on the face of the tube. High brightness also compensates for brightness loss resulting from the use of a neutral density filter needed to increase image contrast. Factors which contribute to high brightness are primarily high current density of the electron beam, and high phosphor efficiency.

Space constraints, especially in behind-the-dashboard installations, place particular restrictions on the overall depth of the VCRT. The total length of the tube is restricted while the deflection angle is increased to more than 100 degrees to achieve a three by eight aspect ratio. The typical five-inch diagonal television tube has a 70 degree deflection angle. In the VCRT this increase in deflection angle maintains overall tube depth, but adversely affects corner spot size performance. The gun length is also restricted by the total tube length constraint. The problem which the gun designer faces, then, is to maintain a standard of center and corner spot size performance in spite of a large deflection angle and gun length constraints.

Quick comprehension of a displayed message for decision making when a potentially hazardous situation is confronted is an important requirement in VCRT's, so the resolution of the tube must be high. The degree of resolution is a function of beam spot size in cathode ray tubes. The center-screen spot size of a VCRT is preferably less than 60 mils at a beam current of 1.5 mA, with the anode potential at 12 kV. By comparison, the spot size for satisfactory performance in a five-inch diagonal CRT is about 80 mils at operating conditions similar to those for a VCRT.

Electron guns used in television picture tubes generally consist of two basic parts: (1) an electron beam source, and (2) a lens for focusing the electron beam on the phosphor screen of the cathode ray tube. Most commerical focus lenses are electrostatic and consist of discrete, conductive, tubular elements which are arranged in sequence on an axis. These electrodes are supplied with predetermined voltages which establish the electrostatic focusing field. A main objective in designing an electron gun is to produce a small, symmetrical beam spot on the tube's cathodoluminescent screen.

The electron beam focus lens of the novel electron gun is classified as a unipotential according to the teachings of present invention. That is, it consists of three electrodes with the center electrode being the focus electrode and the first and third electrodes being at the same potential. Potentials as applied in color television cathode ray tubes are typically 25 to 30 kV on first and third electrodes and zero volts on the center electrode. The voltage on the center electrode is often variable. The prefix "uni" denotes that the potential of the final electrode is the same as that on the initial electrode.

A second type of electron beam focus lens is known as a bipotential. It consists of two electrodes. The first is the focus electrode and typically operates at 6 to 8.5 kV for color television cathode ray tubes. The second electrode is an accelerating electrode and normally operates at potentials of 25 to 30 kV for color television.

In U.S. Pat. No. 4,287,450, Kawakami et al. discloses an electron gun assembly which has " . . . a cathode, an apertured modulator electrode located close to the cathode for controlling the intensity of the electron stream, a first anode in the form of an apertured metal member located close to the modulator, an apertured second anode located close to the first anode and a third cylindrical focusing anode adjacent to the second anode . . . ". The modulator electrode and first anode are supplied with positive potentials which form a cross-over between them. The second anode is supplied with a lower positive potential so that the electron stream emitted from the cathode is formed into a narrow beam, and enters the third anode at a small angle of beam spread. The beam is said to come to focus on the screen of the tube to produce a spot of small cross-sectional area. The effect is to cause the beam to diverge under the influence of the second anode as a result of the relatively lower potential, and converge in the field of the third focusing anode, which is at a relatively higher potential.

Hawken et al in U.S. Pat. No. 4,277,722 discloses a cathode ray tube having two electron lenses in combination which cause a second cross-over of the electron beam between the two lenses. One of the two electron lenses has a variable voltage which dynamically controls the location of the beam cross-over in order to focus the beam onto a display screen at any location away from the screen center. The second cross-over is located within the final electrode of the electron gun. A focusing amplifier provides a potential in the range of 100 to 500 volts for adjusting the focus of the beam.

The unipotential type electron gun has achieved less commercial success than the bipotential-type gun primarily because of its prediliction to arcing in the lower end. The difference in potentials of the final prefocusing electrode and the initial accelerating electrode of a unipotential type gun may be as much as 30,000 volts in guns used in some color cathode ray picture tubes. This great difference in potentials, coupled with the relatively close spacing of the two electrodes, is an incitement to destructive arcing.

Representative examples of electron guns of the unipotential type include those disclosed in Hasker et al.—U.S. Pat. No. 3,919,583; Bortfeld et al.—U.S. Pat. No. 4,124,810; and Sakurai et al.—U.S. Pat. No. 4,232,246.

OBJECTS OF THE INVENTION

It is a general object of this invention to provide an improved electron gun for use in cathode ray tubes.

It is a less general object of this invention to provide an electron gun for vehicular, or other small cathode ray tubes which require brightly displayed graphics to permit the use of a darkly tinted face panel.

It is a more specific object of the invention to provide an electron gun for a cathode ray tube having a spot size sufficiently small to provide maximum display graphics legibility under high brightness conditions.

It is a specific object of this invention to provide an electron gun for a cathode ray tube of short length.

It is another specific object of the invention to provide a gun for a cathode ray tube having an ultra-short gun-to-screen distance.

It is a further specific object of this invention to provide a unipotential electron gun for a vehicular cathode ray tube which has a screen of three-by-eight aspect ratio.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, in which:

DESCRIPTION OF THE PREFERRED EMBODIMENT

Figure 1:
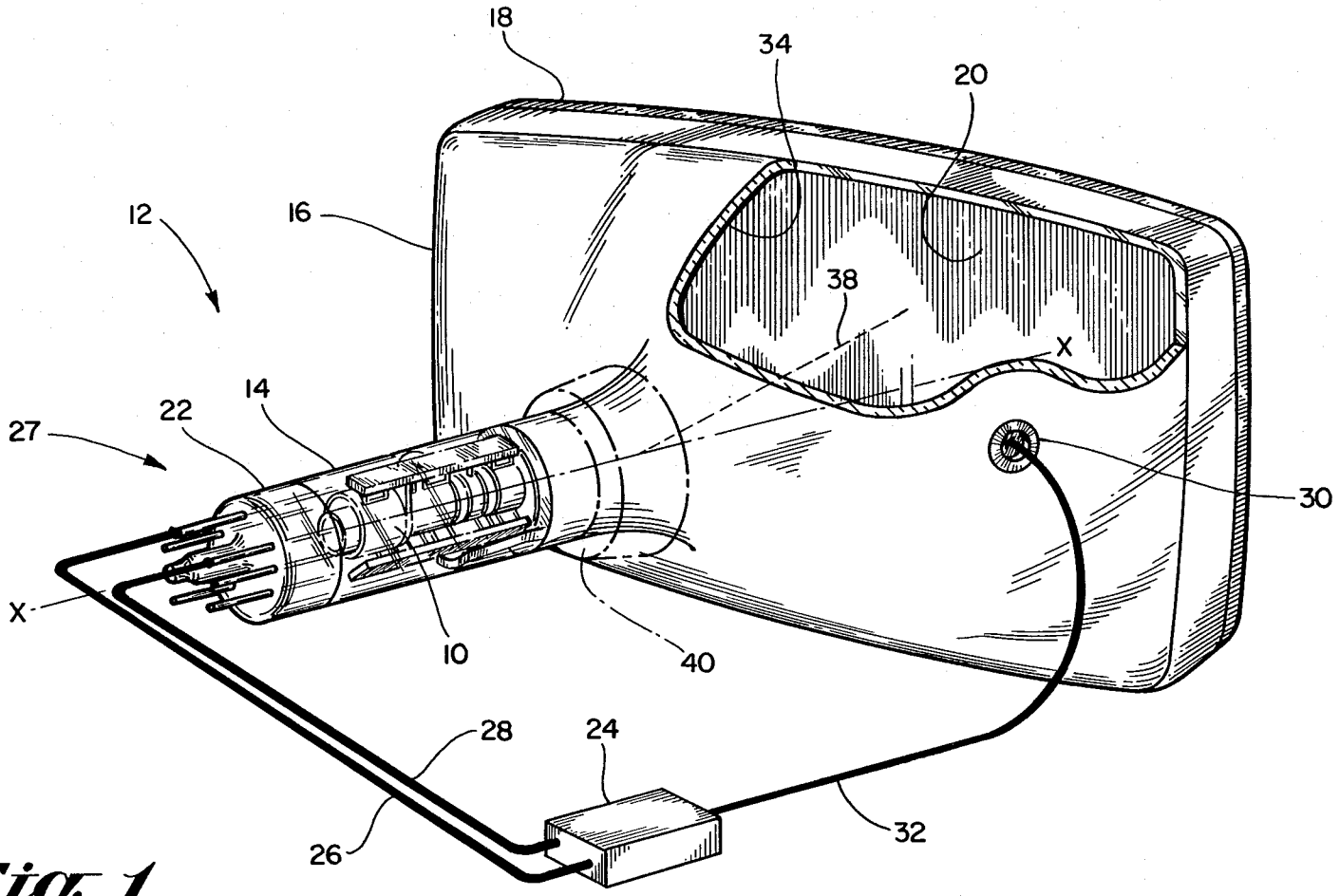
FIG. 1 is a view in perspective of an electron gun according to the invention as installed in a vehicular cathode ray tube having a screen of three by eight aspect ratio.

An electron gun 10 according to a preferred embodiment of the invention, is depicted in FIG. 1. Electron gun 10 is a short, high-performance unipotential-type electron gun for installation in cathode ray tube 12, indicated as being very short. The tube depicted is the type intended for dashboard installation in vehicles. It has an overall depth (or length) of eight inches or less. The deflection angle is approximately 102 degrees and the gun to screen distance is 5.1 inches, by way of example.

The relationship of the electron gun 10 with the picture tube 12 is indicated by FIG. 1. The primary components of the picture tube 12 comprise an evacuated glass envelope including a neck 14, a funnel 16, and a face panel 18. On the inner surface of the face panel 18 there is an imaging screen 20 which consists of a uniform layer of cathodoluminescent material, normally a phosphorescent material, which emits visible light when excited by the impact of a scanning beam of electrons. The emitted light may be white or monochrome (i.e., red, green, or blue), depending upon the nature of the phosphorescent material. The base 22 provides for the connection of voltages to the gun 10. The electron gun 10 according to the invention is located within the neck 14 and is normally aligned with the axis X—X of the tube 12.

The power supply 24, indicated schematically, provides predetermined voltages for application to the electrodes of the gun 12. A special voltage divider circuit is typically incorporated into the power supply to provide a range of potentials required for tube and gun operation. For example, the power supply 24 provides a voltage of about 500 volts through an electrical conductor 26 connected to one of the pins 27 in the base 22. The focus voltage of about 1,700 volts is provided through another of the pins 27 in the base 22. The high voltage of about 12,000 volts is supplied to the anode button 30. The anode button 30 in turn introduces the high voltage through the funnel 16 to make internal contact with a thin, electrically conductive coating 34 deposited on the inner surface of funnel 16 and part way into the neck 14. Two of the electrodes of the gun 10 are connected together as will be described infra and receive the 12,000 volt anode potential through gun centering springs which extend from the end of the gun 10 and make physical contact with the inner conductive coating 34.

The gun 10, which in its preferred embodiment has an inner diameter of 0.230 inch, is depicted as emitting a single electron beam 38 for scanning the cathodoluminescent screen 20. The scanning is accomplished by means of a deflection yoke 40, indicated schematically as encircling the neck 14 and extending part way onto the funnel 16. This yoke preferably scans a deflection angle of about 102 degrees. A yoke of standard commercial design and can be used.

Figure 2:
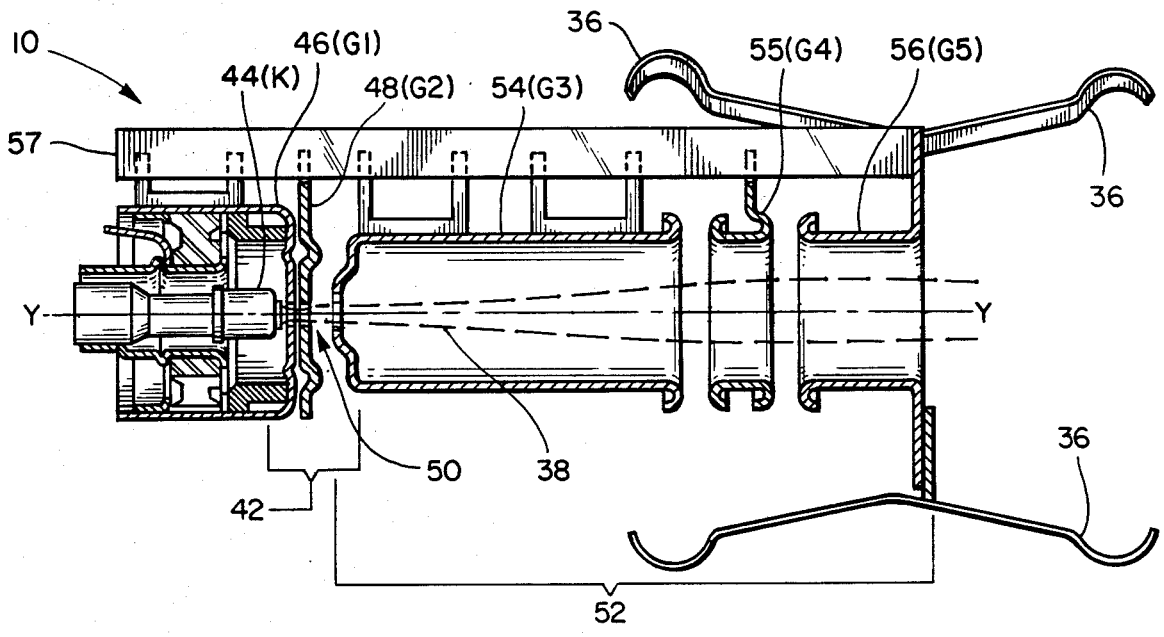
FIG. 2 is a longitudinal elevation in section showing details of the electron gun according to the invention.

FIG. 2 is a detail view of a preferred embodiment of the electron gun 10 according to the invention. Gun 10 is depicted as having a series of electrodes which are supplied with various potentials. The potentials establish electrostatic fields between the electrodes. The electrodes are aligned on an axis Y—Y with certain spacings between, and receive the predetermined voltages from power supply 24 to produce a finely focused beam of electrons on screen 20. Gun axis Y—Y is congruent with the X—X axis of the tube 12. The electron gun according to a preferred embodiment of the invention comprises the following components in the order named.

The lower end 42 of the electron gun, indicated by the bracket, is depicted as comprising a cathode 44 (K) and two electrodes, or grids. The potentials on the cathode 44, the first grid 46 (G1) and the second grid 48 (G2) control the density and trajectory of the electron beam 38 as it is formed and travels through the lower end. The first and second grids consist of apertured discs.

Figure 3:
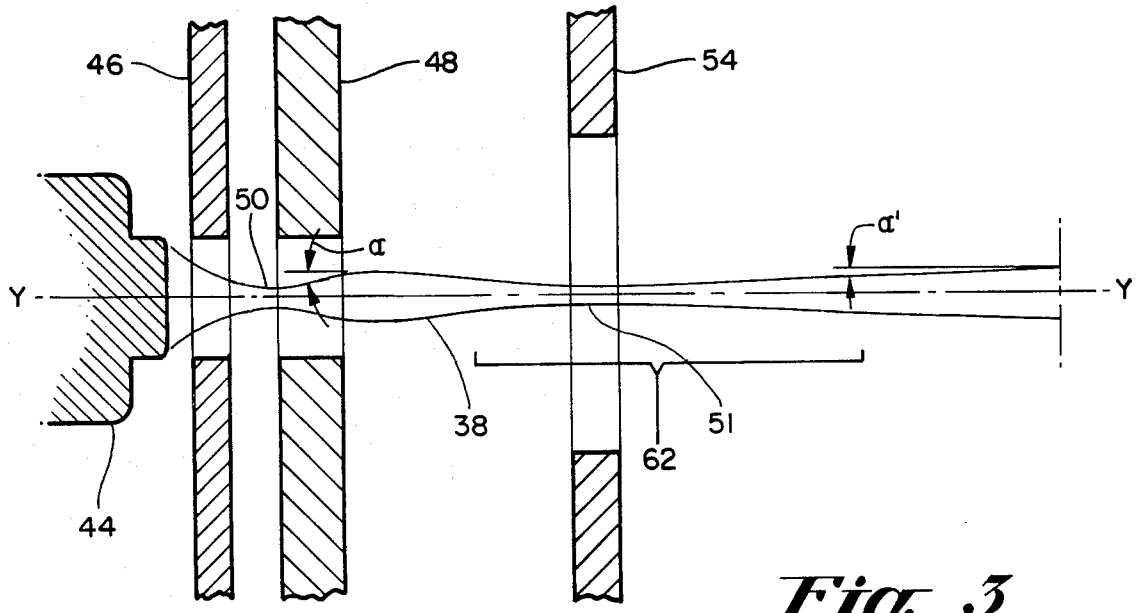
FIG. 3 is a diagram in profile of an electron beam indicating highly schematically the contour of the beam attained by means according to the invention; and, FIG. 4 is a computer plot depicting the contour of the electron beam formed by the means according to the invention.

The second electrode 48 (G2) receives a relatively low voltage of about 540 volts, for example, from the power supply 24. The second electrode 48, along with the cathode 44 and the first grid 46 form an electron beam and cause this beam to cross-over (ref. No. 50 indicates the cross-over). The beam then diverges with angle $\alpha$, where $\alpha$ is from sixty to eighty milliradians. (The contour of the beam 38 in FIG. 3 is exaggerated for illustrative purposes.)

The range of electrical potentials of the cathode 44, first grid 46 and second grid 48 are:

| | |
|---|---|
| K potential (at cut-off) | 75 to 90 volts |
| G1 potential | 0 |
| G2 potential (with K cut-off) | 400 to 600 volts. |

of three to eight and a diagonal deflection angle of 102 degrees; such a tube is depicted in FIG. 1. The "throw" distance is about 5.1 inches; that is the distance between the end of the gun 10 and the surface of the cathodoluminescent screen 20. The unipotential gun according to the invention provides acceptable deflection defocusing performance, providing relatively small spot sizes not only at center screen, but also at the extremes of the corners. At a beam current of 1.0 milliamperes, center screen spot size is about thirty-six mils and the average spot size in the farthest corners is about one hundred and twenty mils.

For the purposes of this disclosure, beam spot size is defined as the diameter from edge to edge of the beam expressed in mils at a landing point on the screen. The "edge" of a beam is defined as those points near the circumference of the beam where the current density due to fall-off is only five percent of the peak current density at the center of the beam.

The center spot sizes for tubes of two aspect ratios—three by four and three by eight—are indicated by the following comparison table:

| Beam Current | 0.2 mA | 0.5 mA | 1.0 mA | 1.5 mA |
|---|---|---|---|---|
| 3 × 8" bulb | 31.6 mil | 31.7 mil | 35.5 mil | 47.2 mil |
| 3 × 4" bulb | 21.9 mil | 21.9 mil | 24.6 mil | 31.5 mil |

There is additional benefit in that the relatively small diameter of the gun makes it possible to fit the gun easily into the small inner diameter of the "mini-neck" tube which has an inside diameter of twenty millimeters.

It is noted that the use of the unipotential gun according to the invention is not limited to cathode ray tubes having a three by eight aspect ratio—the electron gun, with its excellent spot size performance and corresponding excellent resolution, could as well be used in cathode ray tubes in which the screen has the normal three by four aspect ratio, for example. Further, the application of the electron gun according to the invention, and the inventive principles which made it possible, is not limited to cathode ray tubes for vehicles. It is anticipated that the gun according to the principles of the invention can be used in relatively larger television cathode ray tubes, both monochrome and color. In a color gun configuration, three of the guns according to the invention would be used, with the electrodes preferably in unitized form, for example, and the guns arranged in-line or in delta-configuration. Or the gun could be used in black and white monitor tubes of various sizes and for a variety of purposes.

While a particular embodiment of the invention has been shown and described, it will be apparent to those skilled in the art that changes and modifications may be made without departing from the invention in its broader aspects, and therefore, the aim of the appended claims is to cover all such changes and modifications as fall within the true spirit and scope of the invention. The matter set forth in the foregoing description and accompanying drawings is offered by way of example only and is not intended as a limitation. The actual scope of the invention is defined in the following claims when viewed in their proper perspective based on the prior art.

I claim:

1. A high-performance unipotential-type electron gun comprising:

a series of apertured electrodes having electrical potentials thereon for establishing electrostatic fields therebetween, said electrodes being aligned in spaced relation on an axis, and being in the order named, lower end means consisting of a cathode (K) for generating a source of electrons from which an electron beam is formed, an apertured plate control electrode (G1) having an aperture diameter approximately 0.025 in. for controlling, in conjunction with said cathode, the density of said beam, and an apertured plate grid electrode (G2) having an aperture diameter approximately 0.025 in. and spaced approximately 0.010 in. from electrode (G1) for forming, in conjunction with said cathode and said control electrode, a first cross-over constriction in said beam, said beam exhibiting upon divergence from said cross-over construction a relatively steep cross-over emergence angle in the range of 60 to 80 milliradians, said gun including uni-potential focus lens means consisting of a cylindrical initial accelerating electrode (G3) spaced approximately 0.040 in. from electrode (G2), a cylindrical focusing electrode (G4), and a cylindrical final accelerating electrode (G5) for producing a finely focused electron beam, the dimensions and spacings, in conjunction with the potentials applied to the electrodes of said lower end means being effective to induce a second constriction of said beam upon entry of said beam into said focus lens means for providing, upon subsequent divergence of said beam, a relatively shallow focus lens entry angle in the range of 33 to 39 milliradians, said relatively shallow focus lens entry angle being effective to provide for optimum filling of said lens by said beam for producing said finely focused beam of electrons.

2. The electron gun defined by claim 1 wherein the diameter of said second constriction of said beam constitutes, at the point of minimum diameter, approximately 85 percent of the maximum diameter of said beam prior to said constriction.

3. A high-performance unipotential-type electron gun comprising a series of apertured electrodes having electrical potentials thereon for establishing electrostatic fields therebetween, said electrodes being aligned in spaced relation on an axis, and being in the order named, lower end means consisting of a cathode (K) for generating a source of electrons from which an electron beam is formed, an apertured plate grid electrode (G2) for forming, in conjunction with said cathode and said control electrode, a first cross-over constriction in said beam, said beam exhibiting upon divergence from said cross-over constriction a relatively acute cross-over emergence angle in the range of 60 to 80 milliradians, said gun including focus lens means consisting of an initial cylindrical accelerating electrode (G3), a cylindrical focusing electrode (G4), and a cylindrical final accelerating electrode (G5) for producing a finely focused electron beam, the components of said lower end of said gun having the following approximate dimensions and spacing in inches, and potentials in volts—

An electron beam diverging from a cross-over defines an angle with respect to the axis of the gun. The angle, often referred to as "half-angle", "semi-angle", or "divergence angle", gives an indication of beam growth in diameter as the beam diverges from the cross-over. In this disclosure, angle $\alpha$, depicted in FIG. 3, is designated by the more descriptive term "cross-over emergence angle." The angle is normally measured from a selected "cut line" which is desirably a region where the equipotential lines are perpendicular to the gun axis everywhere from the axis to the edge of the field.

In typical electron guns, the cross-over emergence angle is also the angle at which the electron beam enters the lens portion of the gun. The angle is determined by the electrostatic fields in the lower end of the electron gun. The factors which affect formation of the cross-over and subsequent prefocusing of the beam (which results in the cross-over emergence angle) are: the configurations of the first and second grids, spacing between the cathode and the first grid, spacing between the first and second grids, aperture sizes, and the potentials applied to the cathode and first and second grids.

In FIG. 2 the three-element focus lens 52 is indicated by the large bracket. The three elements of the focus lens 52 include an initial acceleration electrode 54 (G3), a focusing electrode 55 (G4) and a final accelerating electrode 56 (G5). These are cylindrical electrodes. Note that, in FIG. 3 the bracket depicting the lower end 42 includes a part of the initial accelerating electrode 54. This overlap is provided to indicate that the field of electrode 54 exerts a significant effect on the contour of the beam 38 as it emerges from the lower end 42.

The gun's lens is of the unipotential type, and the voltages on electrodes 54, 55 and 56 are in the range of 12,000 to 16,000 volts, and preferably about 12,000; 1,500 to 1,900, and preferably about 1,700 and 12,000 to 16,000 volts, and preferably about 12,000 volts. The potentials applied to electrodes 54 and 56 are normally identical in a unipotential gun, so the electrodes may be interconnected. The voltage on electrode 55 is variable for focusing the beam at different current levels. The center electrode is the focus electrode 55. It is about one hundred mils in length in the preferred embodiment which is shorter than typically observed in prior art guns. For typical operating conditions, i.e., 1.5 milliamperes of beam current, eighty volts cut-off and 12,000 volts on the anode the lens fields have a strength of about forty-nine volts per mil. This field strength is the strength as measured on the gun axis Y—Y midway between the two electrodes.

Centering springs 36 extend from the final accelerating electrode 56 and make contact with the inner conductive coating 34; two such springs are shown for illustrative purposes—there are normally three.

Figure 4:
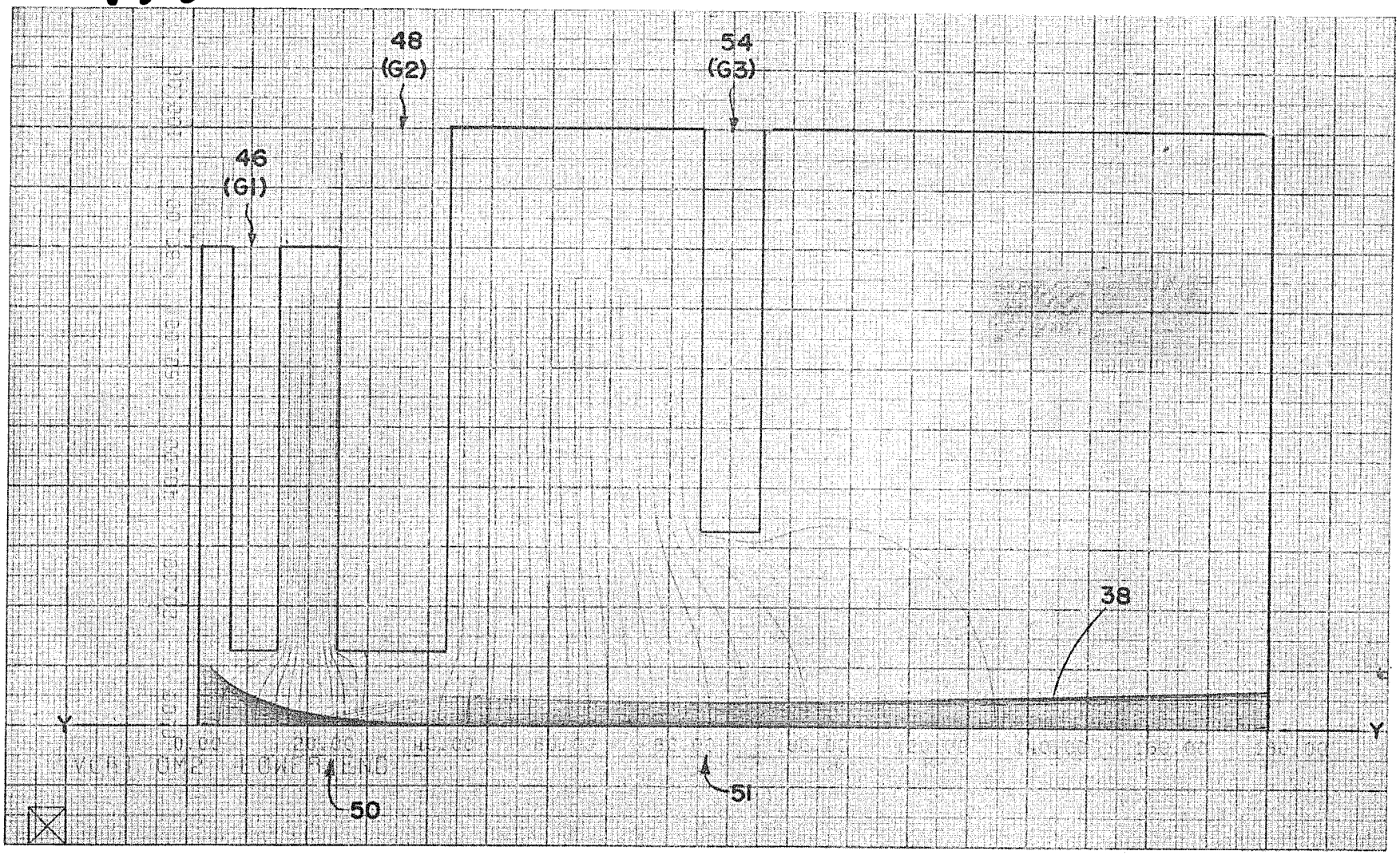

With reference to FIG. 3, wherein the contour of beam 38 is indicated highly schematically, the dimensions, spacings and potentials of the lower end electrodes 44, 46 and 48 induce a second constriction 62 according to the invention of the beam 38; the second constriction 62 is indicated by the bracket. Second constriction 62 occurs as it enters into the focus lens 52. This second constriction provides a relatively shallow focus lens entry angle $\alpha$ in the range of thirty-three to thirty-nine milliradians. This angle provides for optimum filling of the focus lens 52 for producing a finely focused beam of electrons. The diameter of second constriction 62 at its point of minimum diameter 51, constitutes approximately eighty-five percent of maximum diameter of beam 38 prior to constriction 62. A computer plot of the contour of beam 38 attained by the means according to the invention is shown by FIG. 4.

In attempting to achieve small beam spot sizes, gun designers have striven to optimize the amount the beam fills the focus lens by choosing an appropriate focus lens entry angle. The value of this angle is generally considered to be the most important single parameter in gun design.*

*Theoretical and Practical Aspects of Electron Gun Design for Color Picture Tubes", I. M. Wilson, IEEE Transactions on Consumer Electronics, Vol CE-21, No. 1, February 1975.

Unlike the electron gun disclosed in Kawakami et al. (Op.cit.), the gun, according to invention has no unusual geometry or auxiliary electrodes. For example, the Kawakami el al has an uncommonly thin G1 of 2.5 mils in thickness with a relatively small aperture of about 12 mils. The G2 aperture of Kawakami et al is about 20 mils, and the K-G1 spacing is about 2.54 mils. The relatively small spots alleged by kawakami et al would seem to be attributable to the constraints of this geometry, wherein the apertures and spacings are relatively small. The disadvantages of such geometry lie in difficulty in manufacturing such a gun. In addition, the kawakami et al. gun has an auxiliary electrode termed a "second apertured electrode", which acts as a prefocus electrode and is said to provide a smaller cross-over emergence angle.

The unipotential type gun according to the invention has a length between 1.4 and 1.6 inches, and in its preferred embodiment, a length of 1.5 inches. The preferred embodiment has additionally, the following dimensions and spacings in inch measure:

| | |
|---|---|
| K-G1 spacing (cold) | 0.005 |
| G1 aperture diameter | 0.025 |
| G1 thickness, at aperture | 0.008 |
| G2 aperture diameter | 0.025 |
| G2 thickness, at aperture | 0.018 |
| G1–G2 spacing | 0.010 |
| G2–G3 spacing | 0.042 |
| G3 axial length | 0.580 |
| G3 aperture diameter | 0.065 |
| G3 thickness at aperture | 0.010 |
| G3 lens diameter | 0.230 |
| G4 lens diameter | 0.230 |
| G4 axial length | 0.100 |
| G3–G4 spacing | 0.050 |
| G5 lens diameter | 0.230 |
| G5 axial length | 0.250 |
| G4–G5 spacing | 0.050 |
| Focus lens diameter | 0.230 |
| Gun length | 1.50 |

The optimum parameters of the electron gun according to the preferred embodiment of the invention are definable by the following approximate ratios, wherein there is— a G2 aperture diameter to the distance bestween G1 and G2 ratio of 2.5;

a G2 aperture diameter to the distance between G2 and G3 ratio of 0.59;

a G3 aperture diameter to G3 lens diameter ratio of 0.28;

a G4 potential to G3–G5 potential ratio of 0.14;

a G4 axial length to lens diameter ratio of 0.45;

a G4 axial length to gun length ratio of 0.10 (gun length as measured from the cathode surface to the end of the grid).

This electron gun is well suited for use in a cathode ray tube wherein the viewing screen has an aspect ratio

| | |
|---|---|
| K-G1 spacing (cold) | 0.005 |
| G1 aperture diameter | 0.025 |
| G1 thickness, at aperture | 0.008 |
| G2 aperture diameter | 0.025 |
| G2 thickness, at aperture | 0.018 |
| G1-G2 spacing | 0.010 |
| K potential (at cut-off) | 75 to 90 |
| G1 potential | 0.0 |
| G2 potential (with K cut-off) | 400 to 600 |
| G3 potential | 12,000 to 16,000 |
| G4 potential | 1,500 to 1,900 |
| G5 potential | 12,000 to 16,000 |

said dimensions, spacing and potentials being effective to induce a second construction of said beam upon entry of said beam into said focus lens means for providing, upon subsequent divergence of said beam, a relatively shallow focus lens entry angle in the range of 33 to 39 milliradians, said relatively shallow entry angle being effective to provide for optimum filling of said main focus lens means by said beam for producing said finely focused beam of electrons.

4. The electron gun defined by claim 3 wherein the diameter of said second constriction of said beam constitutes approximately 85 percent of the maximum diameter of said beam prior to said constriction.

* * * * *